United States Patent [19]

Farrell

[11] 4,045,892

[45] Sept. 6, 1977

[54] HYDRAULICALLY OPERATED FRONT AND REAR WING HANGERS FOR SNOW PLOWS

[75] Inventor: Eugene A. Farrell, Fishers Landing, N.Y.

[73] Assignee: Frink Sno-Plows, Clayton, N.Y.

[21] Appl. No.: 739,499

[22] Filed: Nov. 8, 1976

[51] Int. Cl.[2] ..... E01H 5/00

[52] U.S. Cl. ..... 37/50; 37/105

[58] Field of Search ..... 37/41, 42 R, 42 VL, 37/44, 46, 50, 105; 172/801-809

[56] References Cited

U.S. PATENT DOCUMENTS

| | | | |
|---|---|---|---|
| 1,742,327 | 1/1930 | Tellis | 37/105 |
| 1,754,778 | 4/1930 | Tellis | 37/105 |
| 1,873,794 | 8/1932 | Speno | 37/105 |
| 2,101,666 | 12/1937 | Austin | 37/44 |
| 2,524,329 | 10/1950 | Richardson | 37/44 |
| 2,632,262 | 3/1953 | Whittey | 37/42 R |
| 2,643,470 | 6/1953 | Kaeser | 37/105 X |
| 2,906,041 | 9/1959 | Shipley et al. | 37/105 |
| 3,125,818 | 3/1964 | Kraft | 37/42 R |
| 3,429,381 | 2/1969 | Launder et al. | 172/802 |
| 3,805,424 | 4/1974 | Renahan | 37/42 VL |

FOREIGN PATENT DOCUMENTS

| | | | |
|---|---|---|---|
| 609,001 | 11/1960 | Canada | 37/42 R |
| 606,485 | 9/1960 | Canada | 37/50 |
| 302,518 | 12/1928 | United Kingdom | 37/105 |

*Primary Examiner*—E. H. Eickholt
*Attorney, Agent, or Firm*—Bruns & Jenney

[57] ABSTRACT

A truck has a pusher frame secured to its front end and has a space between its cab and its body at the rear. A front post is secured to the pusher frame and a rear post is secured to the vehicle frame between the cab and body. Each post includes a vertically disposed rectangular tubular way having a slot along one side and a double acting hydraulic cylinder having its piston rod secured to the bottom end of the way and the lower end of its cylinder secured to the rectangular portion of a pair of spaced plates adapted to slide within the posts. The cylinder has a piston secured to the upper end of a double tubed piston rod, one tube being telescoped within the other and having an annular space therebetween, the central tube extending beyond the other at each end. Both connecting rod tubes have means for admitting fluid under pressure at their lower ends, the space between the tubes being sealed at this end, the inner tube extending through the piston at its top for expanding the device and the outer tube having openings below the piston for connecting the space between the tubes to the cylinder for lowering the cylinder. The pair of spaced plates of the slide have a narrow tongue portion projecting through the post slots and connected to a vertically extending slide portion slidable on the exterior of the post. A patrol wing plow blade has its front end pivotally connected to the front post slide and its trailing end pivotally and adjustably connected by a plurality of arms to the rear post slide.

7 Claims, 16 Drawing Figures

27
41
44
45
40
39
42
43
38
36
35
37
46
47
94
94a
75'
45'
99
98
97
41'
40
35'
95
26

HYDRAULICALLY OPERATED FRONT AND REAR WING HANGERS FOR SNOW PLOWS

BACKGROUND OF THE INVENTION

The present invention relates to vehicle mounted hanger means for a patrol wing snow plow blade having substantially vertically disposed front and rear posts or ways, slide means on each post connected to the blade ends, and two-way hydraulic means in each post for raising and lowering the slide means.

Prior art patrol wings included lifting means comprising steel cables running over sheaves or pulleys requiring view-obscuring support structures and frequent cable replacement or repair. Rear post assemblies frequently were so large that moving of the body rearward of the cab was necessary.

SUMMARY OF THE INVENTION

The present invention contemplates a substantially vertical tubular support post at the side of the vehicle at the front and at the side of the vehicle behind the cab, the bottom portion of each post being secured to the vehicle frame. Each post has a vertically extending slot and slide means having a portion slidable in the tube, narrow portions extending through the slot, and exterior slide portions including a vertically extending portion adapted to slide along the exterior of the post. The front post exterior portion of the slide bears means for pivotally securing it to the front end of the blade and the rear post exterior portion of the slide bears means for pivotally securing it to the inner ends of an upper and a lower harness arm whose outer ends are pivotally secured to the trailing end of the blade. A patrol wing operating hydraulic cylinder extends from the inner end of the lower arm to the outer end of the upper arm for angularly adjusting and raising the blade, spring means being provided on the upper arm for allowing tripping of the blade. The post slides thus become hanger means for the blade.

The slides are each secured to the lower end of a novel double-action hydraulic cylinder within the post. Each cylinder has a piston therein connected to a double tube piston rod, one tube being telescoped inside the other and the outer tube having an annular space between it and the inner tube. At its lower end the double tube rod is secured to a plate secured across the lower end of the post, the inner tube projecting beyond the outer tube and the annular space between the tubes being sealed at this end. Each tube at this end is provided with nipple means for connecting it to a source of liquid under pressure.

At its upper end each tube of the connecting rod is secured to the piston, the inner tube extending through the piston to connect its passage to the cylinder above the piston. The outer tube, just below the piston has passage means therethrough connecting the annular space between tubes to the interior of the cylinder below the piston. Thus the slide is raised by hydraulic fluid through the inner tube and lowered by hydraulic fluid through the outer tube.

The cylinder is double-acting so it is positive in action. The lower end of the piston rod is secured to the lower end of the post and the lower end of the cylinder is directly connected to the slide and is, of course, hydraulically operated.

The rear post has a novel construction enabling it to be installed in a minimum of space between cab and truck body and the slide way means faces in a direction in which the harness arms normally extend when the patrol wing plow is in operative position.

DESCRIPTION OF THE PREFERRED EMBODIMENT

Figure 1:
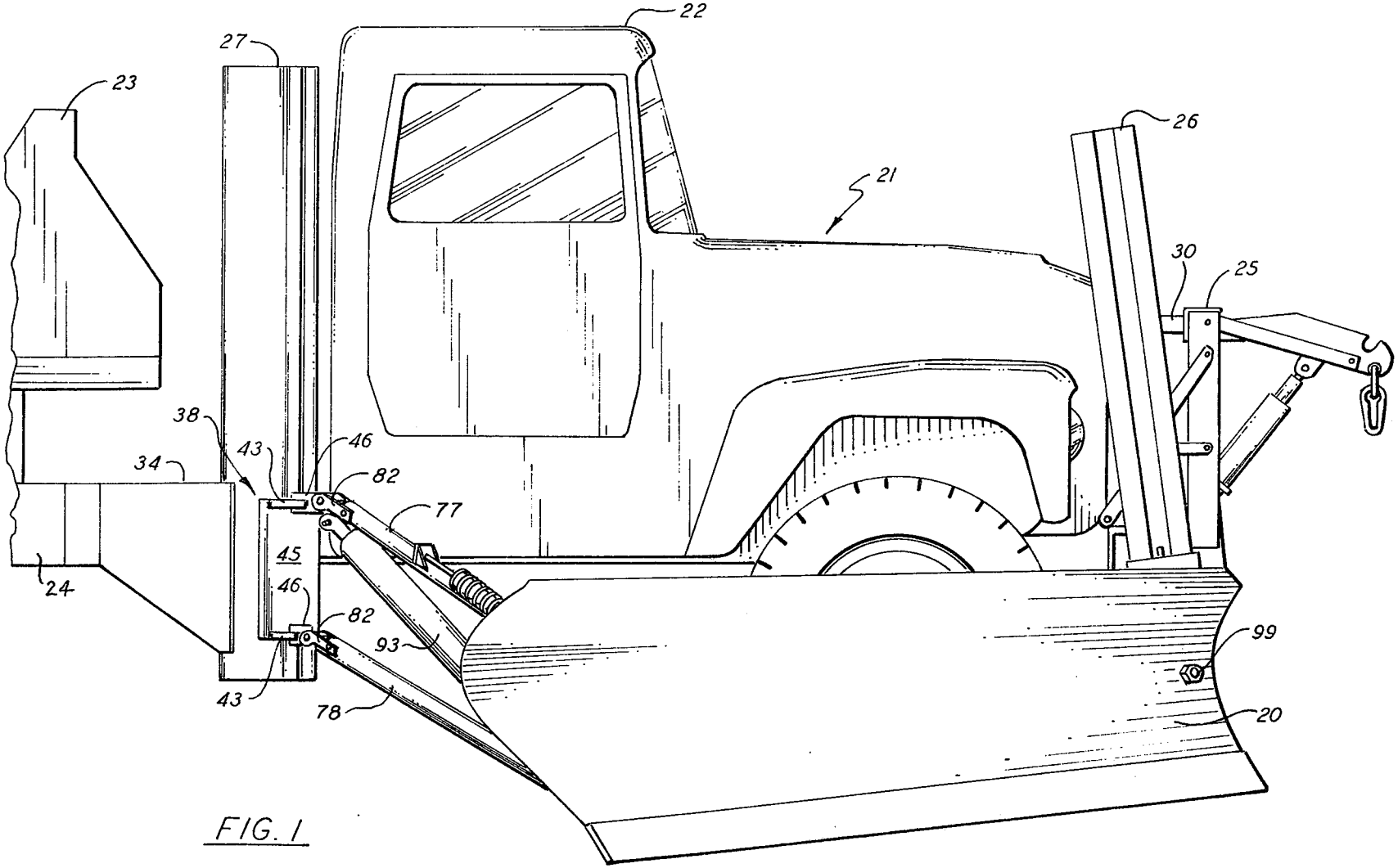
FIG. 1 is a side elevational view of a patrol wing plow mounted on hangers according to the invention on a truck fragmentarily shown.
Figure 2:
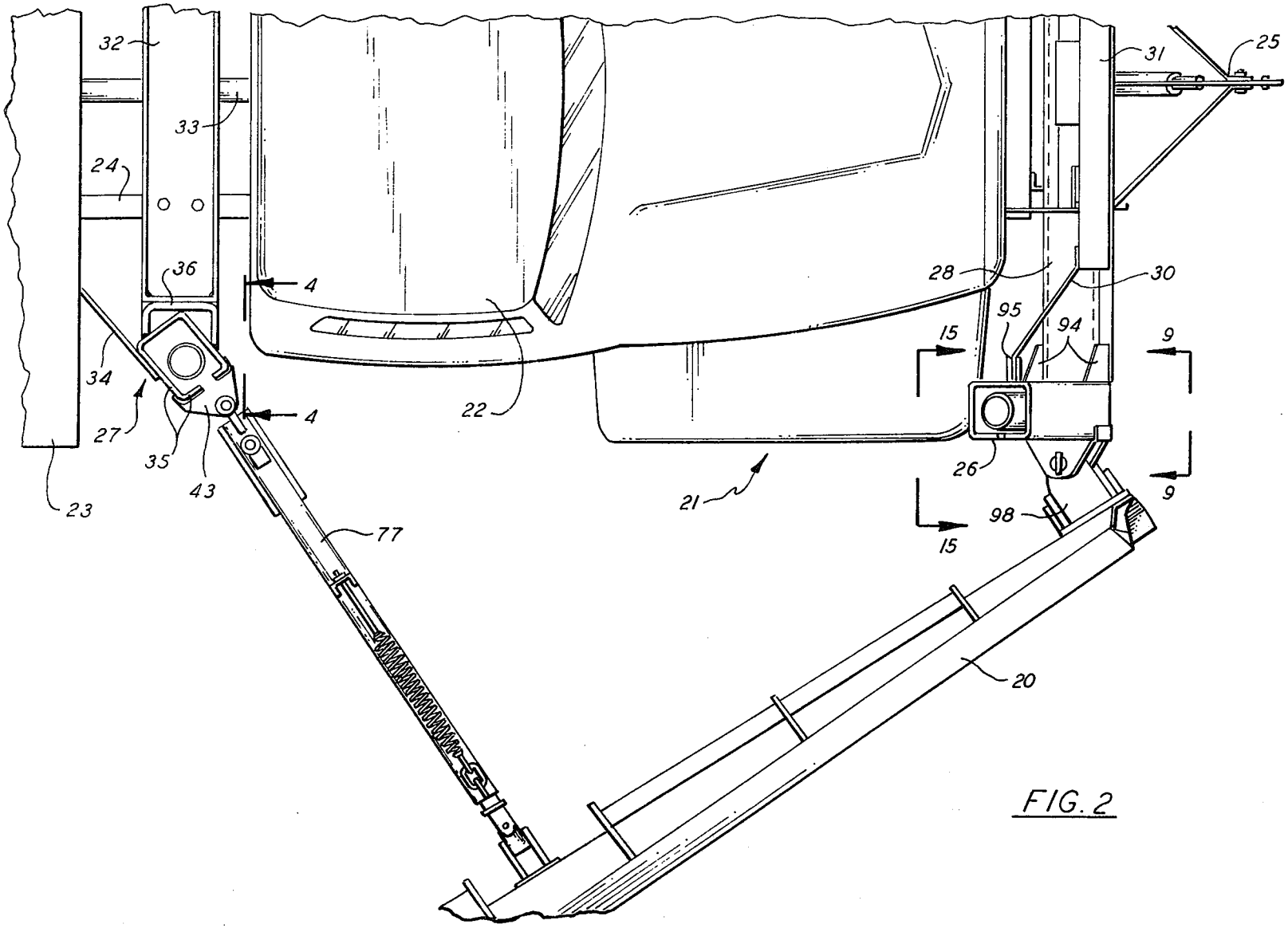
FIG. 2 is a fragmentary plan view and FIG. 3 is a front elevational view of the parts shown in FIG. 1.
Figure 3:
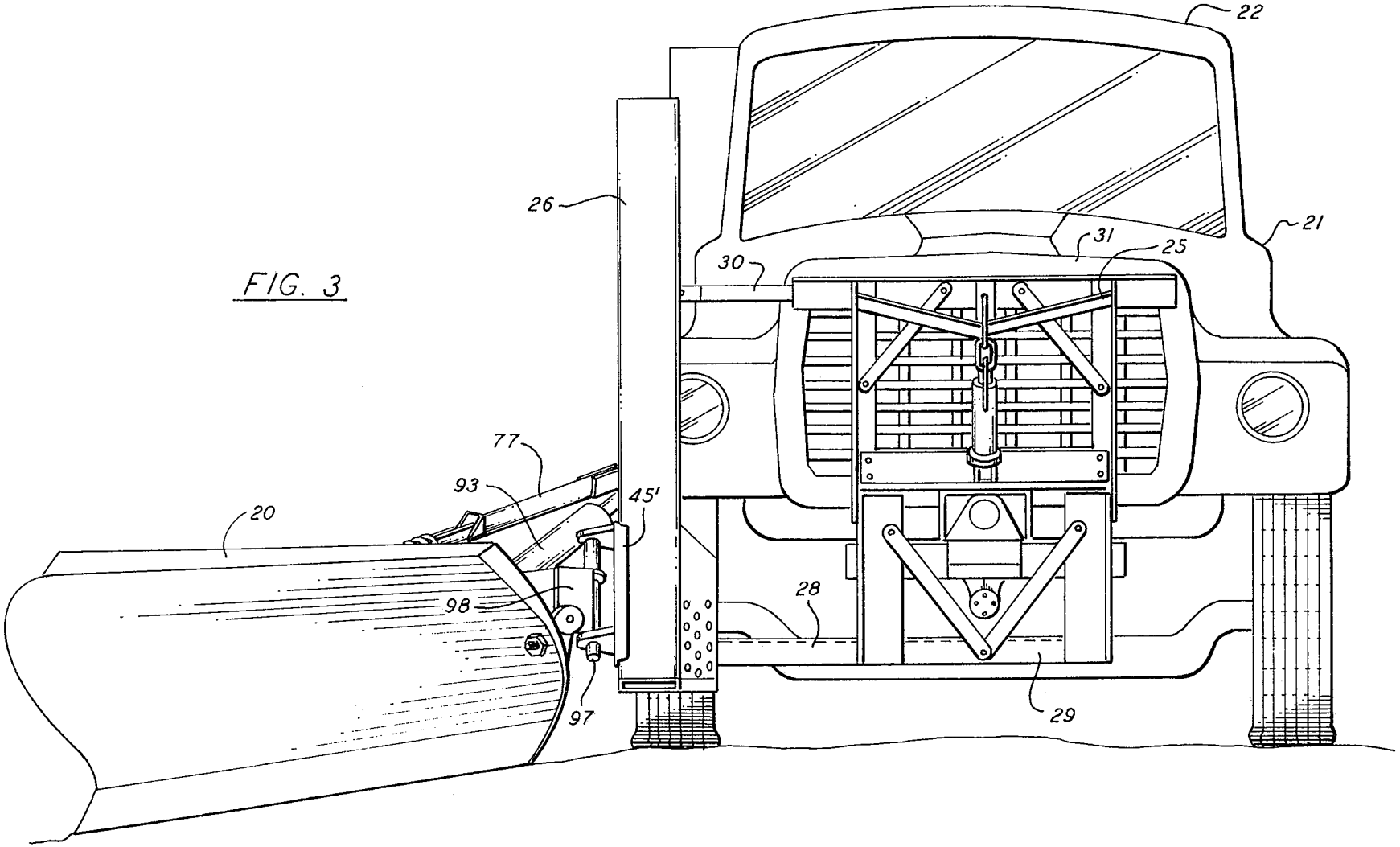

Referring to FIGS. 1–3 a patrol wing plow blade 20 is shown secured to the right hand side of a vehicle 21, here shown as a dump truck with a cab 22 and a body 23 mounted on right and left side chassis members 24. A pusher frame 25 is shown secured to the front end of the vehicle, it being understood that it is adapted to push before the vehicle a snow plow riding on skids and which may be a one way, a two way, or a reversible plow. The patrol wing plow is used to plow snow from the side of the road when in the position shown, or may be used to plow back the top of banks of snow piled up by previous plowing when raised by means to be described. It may also be raised and swung against the side of the vehicle with trailing end elevated when it is carried not in use.

Vehicle 21 is provided with a front post 26 and a rear post 27 mounted between cab 22 and body 23. Referring to FIGS. 2 and 3, front post 26 may be secured to a cross-member 28 which may be a channel member welded or otherwise secured to the bottom cross member 29 of the frame 25, as shown in FIG. 3, and other cross members of the truck or push frame. Other brace members, such as member 30 welded to a top cross member 31 (FIG. 3) of the push frame may be provided.

Rear post 27 is supported near its bottom end by a cross member 32 having an apertured plate welded to the outer end thereof and bolted, or otherwise secured, to both longitudinally extending chassis members 24 between the cab and truck body as indicated in FIG. 2, the vehicle drive shaft 33 being there shown below cross member 32. Another brace member 34, shown in FIG. 1 is secured to post 27 and one frame side member 24 by welding or otherwise.

Figure 4:
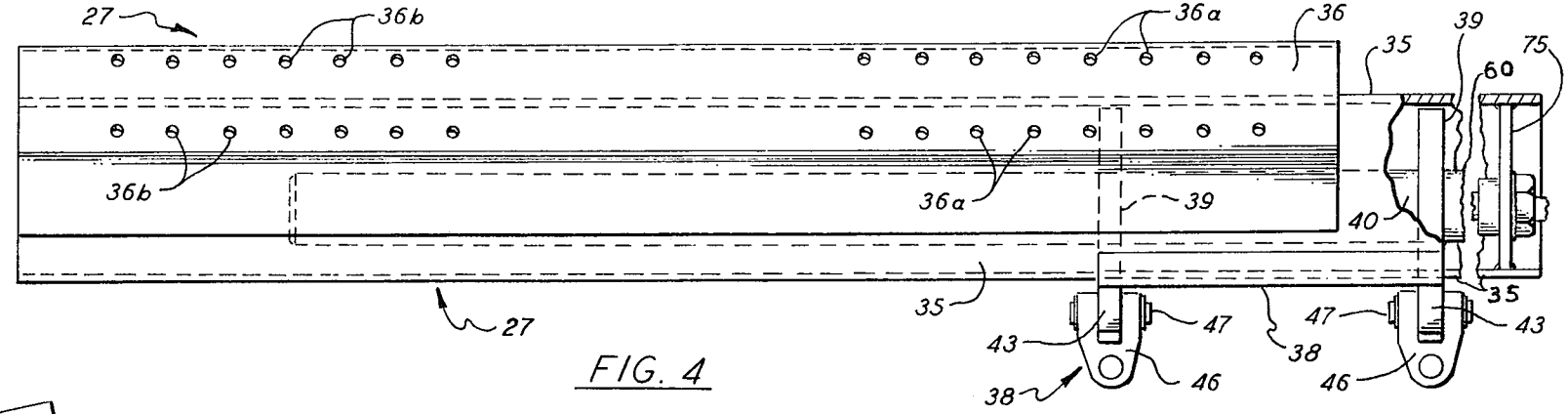
FIG. 4 is an enlarged side elevational view of the rear post assembly as viewed in the direction of the arrows 4—4 of FIG. 2.
Figures 5, 7, 9:
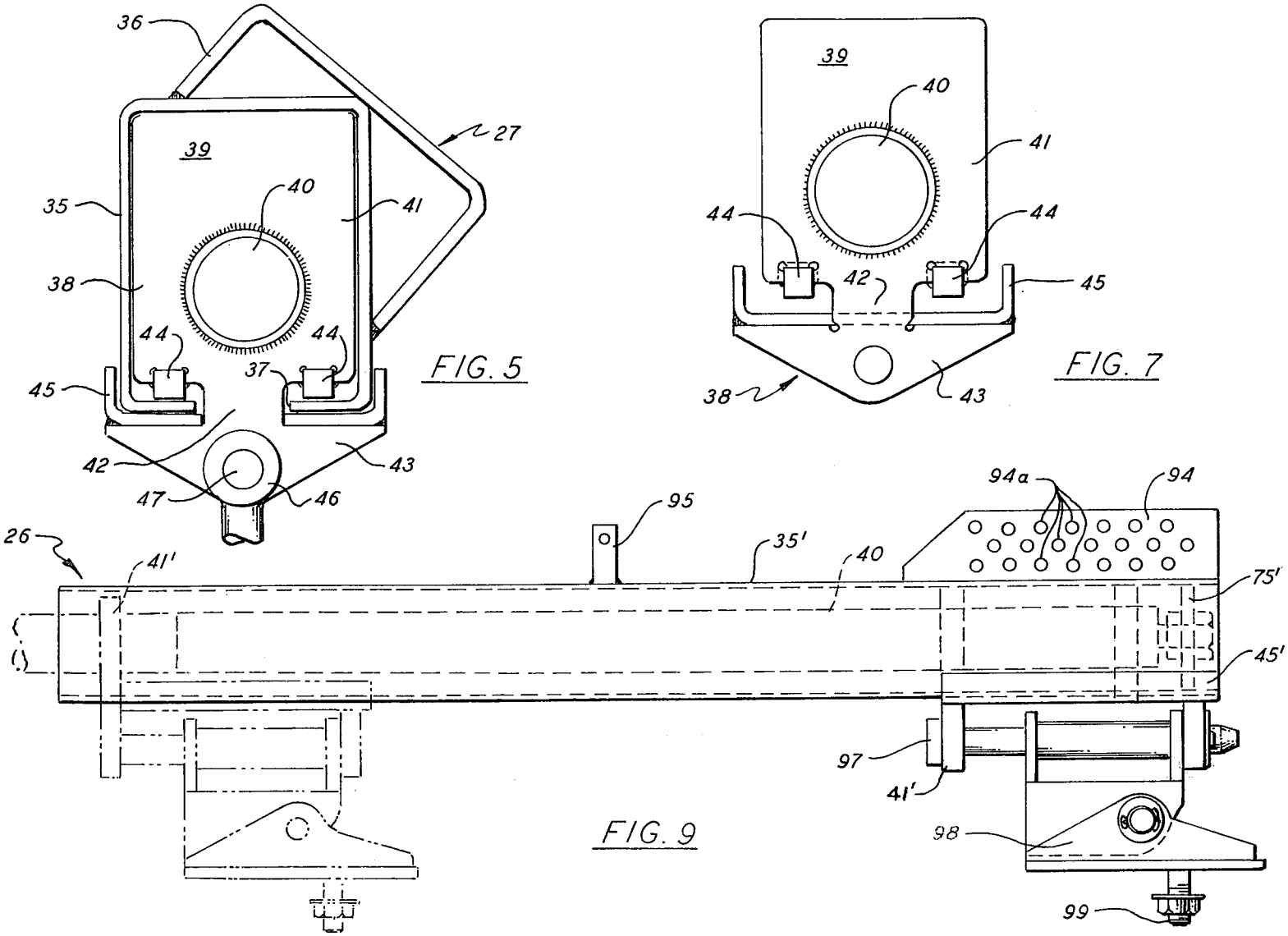
FIG. 5, on sheet 5 of the drawings, is a further enlarged plan view of the rear post.
FIG. 7 is an enlarged plan view of the rear post slide.
FIG. 9 is a side elevational view of the front post assembly as viewed in the direction of the arrows 9—9 of FIG. 2.
Figure 12:
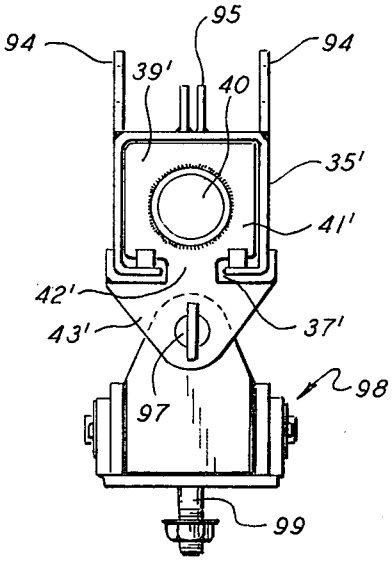
FIG. 12 is an enlarged plan view of the front post.
Figure 13:
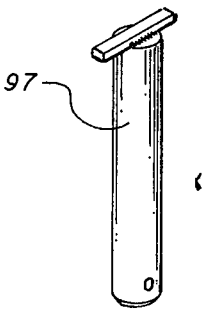
FIG. 13 is a further enlarged perspective view of a pivot pin shown in FIG. 12.
Figure 8:
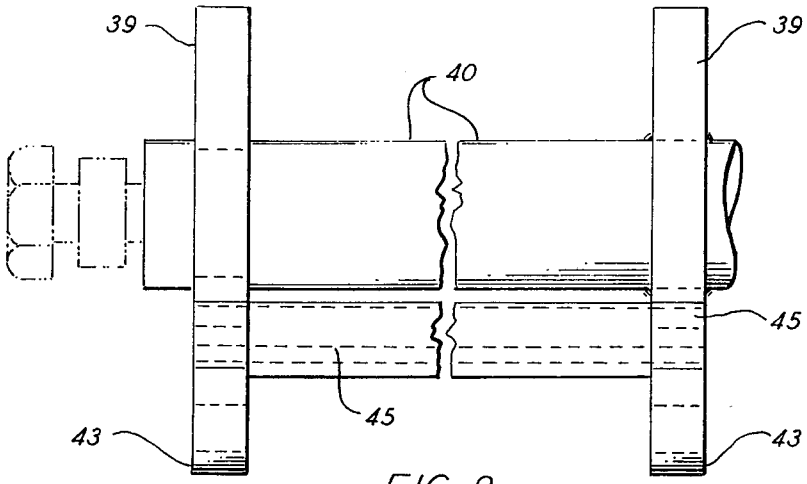
FIG. 8, on sheet 7 of the drawings, is a fragmentary side elevational view of the rear post slide.

Post 27, best seen in FIGS. 4 and 5, comprises vertically disposed way member 35 and reinforcement member 36 welded thereto. The way member 35 is a tubular post, rectangular in cross section and with a longitudinally extending slot 37 in one side thereof (FIG. 5). The reinforcing member 36 is a substantially U-shaped channel whose legs or flanges are welded to the way member 35 on either side of a corner of the way member so that its web portion is disposed at an angle of substantially 30° to the slotted side, as shown in FIG. 5. When the refinforcement member is secured to the vehicle chassis, its web portion abuts the end of the cross-member 32, to which it is secured and the way member slotted side faces forward at a substantially 30° angle to the direction of travel of the vehicle as best seen in FIG. 2.

Reinforcement member 36, it will be noted, is shown in FIG. 4 as having a plurality of holes **36*a* therethrough at its bottom end for selectively containing a pair of bolts therethrough and through the end plate of cross member 32. Member 36 also has a plurality of holes 36*b* therethrough at its top end for selectively containing a pair of bolts therethrough and through such another brace as may be desired for securing post 27 to the truck cab 20** or the truck body portion of trucks which are not dump trucks.

Referring to FIG. 2, it will be noted that the reinforcement member 36 lies between cab 22 and body 23, and, being a reinforcement member only, may be held to a minimum size. The way member 35, being at an angle to member 36 lies partially within member 36 so that the forward to rear dimension of post 27 exceeds by very little the forward to rear dimension of member 36.

A rear post slide 38, best seen in FIGS. 4 and 7, has a pair of spaced plates 39—39 secured to the lower end of a hydraulic cylinder 40, as shown, within the way 35, the cylinder extending through aligned holes in the plates. Each plate 39 has a rectangular portion 41 adapted to slide within the way member 35 and a narrowed tongue portion 42 extending through the slot 37 and terminating in a broadened portion 43 spaced from the rectangular portion 41. Portion 41 of each plate has a longitudinally extending friction member 44 welded thereto on either side of tongue 42 adapted to slide against the inner surface of the slotted side of the way member 35. Similarly, the broadened portions 43 of the plate members are connected by a channel shaped friction member 45 adapted to slide against the outer face of the slotted side of the way member 35, the member 45 being welded to the inner edge of portion 43 of each plate as shown in FIG. 5. Each portion 43 has a hole therethrough and a swivel link 46 is secured thereto by a pin 47, as shown in FIG. 4.

Figure 10:
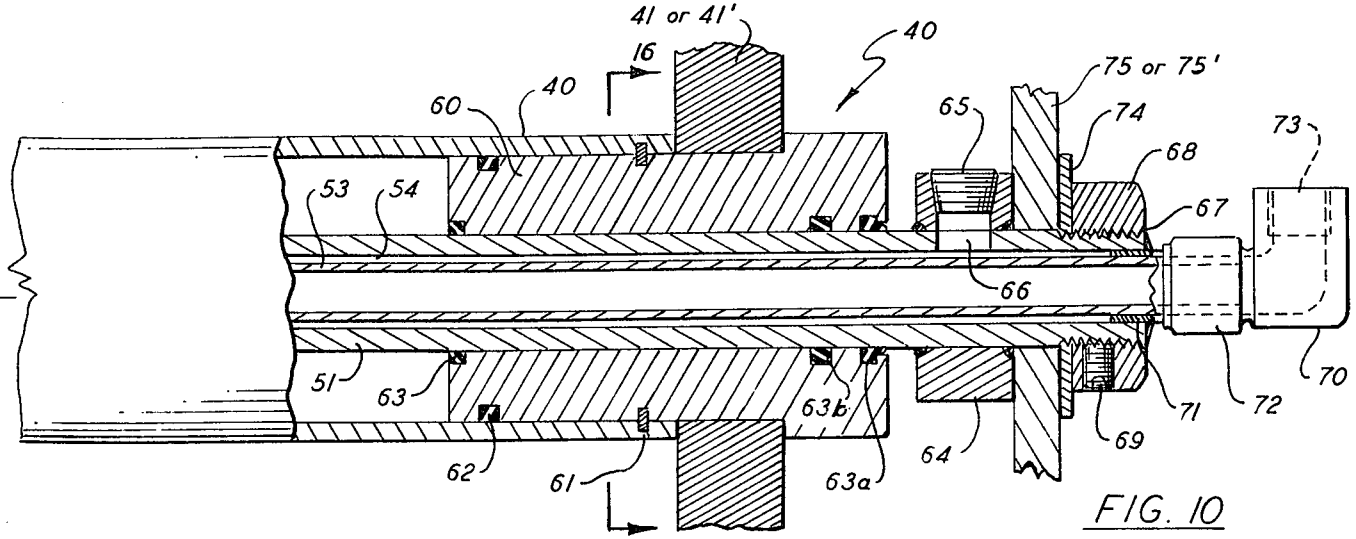
FIGS. 10 and 11 are fragmentary, enlarged, side elevational views of the double action operating cylinder used in the front and rear posts, FIG. 10 showing the lower end partly in section and FIG. 11 showing the upper end partly in section.
Figure 11:
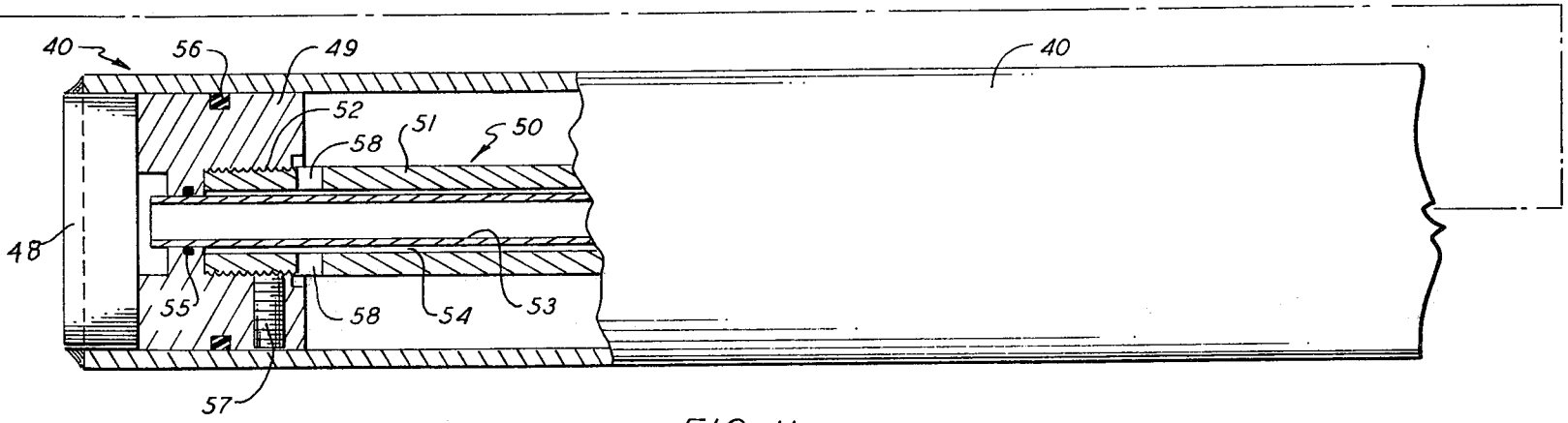

Referring to FIGS. 10 and 11, the hydraulic cylinder 40 is shown closed by a plate 48 welded to its upper end and having a piston 49 therein. Secured to the piston is a double tube connecting rod 50 having an outer tube 51 threadedly engaged at 52 with the piston 49 and an inner tube 53 concentric with and inside tube 51. The inner diameter of tube 51 exceeds the outer diameter of tube 53 leaving an annular space 54 between the tubes. The inner tube 53 is in sealed engagement at 55 with piston 49, protrudes above tube 51 and its passage is in communication with the interior of cylinder 40 above the piston. A piston ring or O-ring 56 is provided around the piston and a set screw 57 is provided for locking the piston on tube 51. Diametrically opposite holes 58—58 are provided through the sidewall of tube 51 near piston 49 so that the annular space 54 is in communication with the interior of cylinder 40 below piston 49.

The double tube piston rod 50 extends down through the cylinder to its lower end where it extends through a tubular cylinder head 60 closing the lower end of the cylinder. Head 60 is secured to the lower end of the cylinder by a stainless steel retaining key 61 which allows removal of the head 60 from the cylinder 40 for seal replacement, as hereinafter described. A sealing ring 62 is provided around the head for sealed engagement with the cylinder sidewall. A sealing ring 63 is also provided in an annular slot in the head for sealing engagement with the outer tube 51. A rod wiper **63*a* is mounted outboard of the seal and another annular seal may be provided at 63*b***.

Below head 60, a collar 64 is welded to tube 51 as shown and the collar is provided with a threaded passage 65 for the reception of a nipple, and in communication through passage 66 through tube 51 with the annular space 54 around tube 53. Spaced from collar 64, the tube 51 terminates in a threaded end at 67 and a nut 68 is provided for engagement with the threads. Nut 68 is provided with a locking setscrew 69. Tube 53 extends beyond tube 51 and is provided with a threaded el fitting engaging the threaded end of tube 53. The fitting 70 is provided with a tubular portion 71 above its threaded portion at 72 and this tubular portion is proportioned to exactly fit the annular space 54 between tubes 51 and 53 and the end of tube 51 is welded to the tubular portion 71 to effectively seal the lower end of the annular space 54 between tubes. The other end of fitting 70 is threaded for the reception of a nipple at passage 73.

A washer 74 is provided above nut 68 and, by tightening the nut, an orificed bar 75 may be locked between nut 68 and collar 64. As best seen in FIG. 4, the bar 75 is welded across the lower end of the way member 35. It will thus be seen that appropriate nipples in passages 65 and 74 (FIG. 10) may be connected through tubing controlled by appropriate valve means to a source of fluid under pressure to lower cylinder 40 and the attached slide 38 by conducting the pressure fluid through the annular space 54 between tubes and to raise the slide and cylinder by conducting pressure fluid through the passage through tube 53. The lower end of the double tube connecting rod 50 being secured to the bar 75, passages 65 and 73 remains fixed and it is not necessary to provide flexible tubing.

Figure 6:
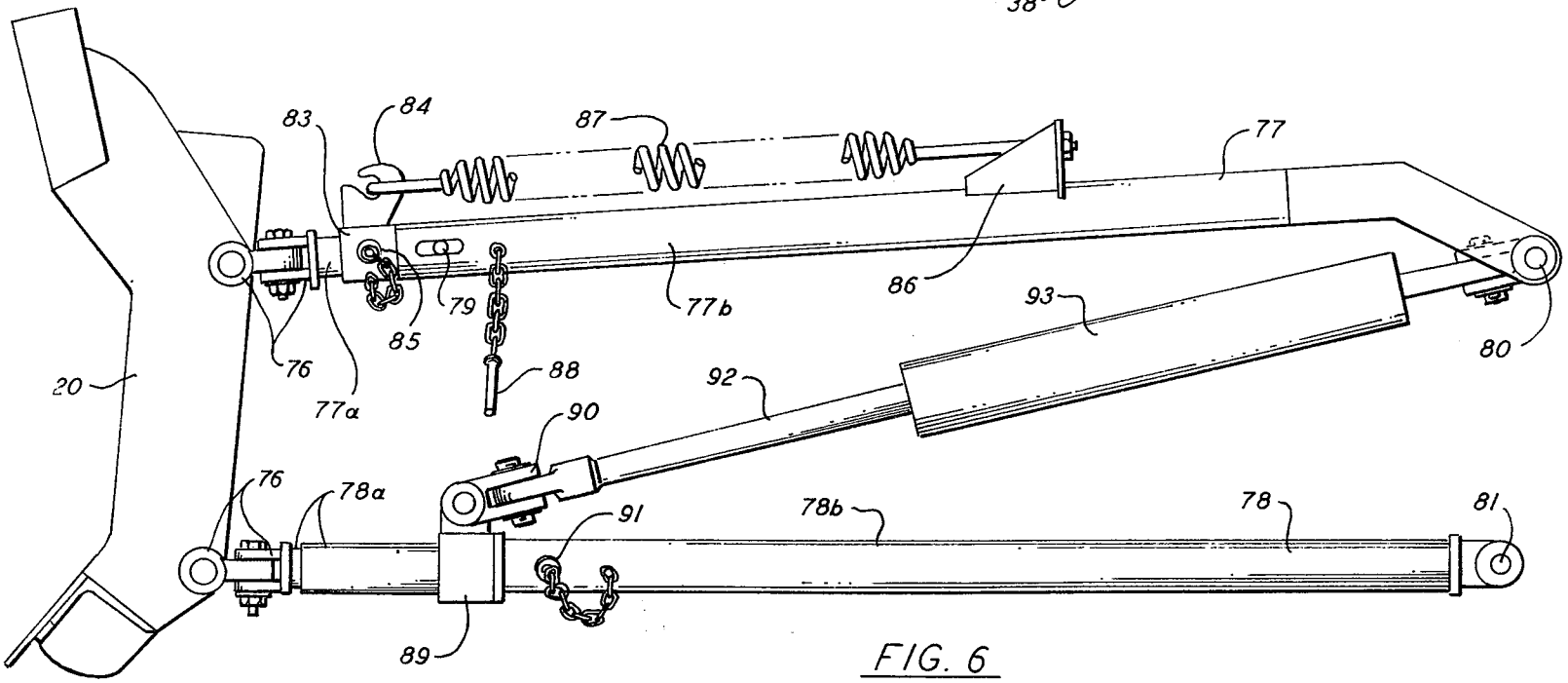
FIG. 6 is an enlarged side elevational view of the trip harness, showing the plow blade in end elevation.

Referring now to FIG. 6, the patrol wing plow 20 is connected by appropriate swivel links at 76 to the outer ends of upper harness arm 77 and lower harness arm 78. It will be understood that both arms comprise an inner rod portion **77*a* and 78*a* telescoped within an outer tubular portion 77*b* and 78*b*. Each inner rod portion has a plurality of longitudinally spaced holes therethrough, one of which may be seen at 79**.

The inner ends of arms 77 and 78 are provided with swivels at 80 and 81 respectively. Referring to FIG. 1, the two swivel links 46 carried by slide 38 are each connected by a second swivel link 82 to the inner ends of the two harness arms at 80 and 81, respectively. Again referring to FIG. 6, the upper arm 77 has a collar 83 bearing a hook 84 secured thereon adjustably secured on the outer end thereof by a pin 85 through one of the holes 79. The tubular portion **77*b* of the arm has a bracket 86 secured thereon and a coil spring 87 extends from hook 84 to bracket 86 allowing blade 20 to trip by extension of spring 87 when the blade meets an obstruction in the road. A pin 88 is provided for insertion in the appropriate hole 79** for preventing this trip action when desired.

The outer end **78*a* of the rod portion of the lower arm has a collar 89 thereon carrying a swivel link 90 and arm 78 may be extended by withdrawing pin 91 extending the arm and reinserting pin 91 in a selected hole 79. The swivel link 90 on collar 89 is connected to a swivel member carried on the piston rod 92 of a hydraulic cylinder 93 which may be operated by flexible tubing (not shown) connected to a source of fluid under pressure. The inner end of cylinder 93 has a swiveled connection to the inner end of arm 77. It will be apparent that the harness arms may be quickly adjusted in length and the outer end of the patrol blade may be adjusted by cylinder 93** for supplying raising and lowering force on this end of the blade.

Although the inner end of cylinder 93 is shown connected to the swivel 80 carried at the inner end of arm 77, it will be apparent that, for reasons of strength, the inner end of cylinder 93 may be provided with separate swivel means carried on the slide 38.

Referring now to FIGS. 9–15, the front post assembly 26 is very similar to that of the rear post but somewhat smaller and inclined at a small angle to the rear of the vertical allowing the front end of blade 20 to be carried at a lower level than the rear end of the blade when the blade is elevated and out of use thus interfering less with the view of the driver. The inclination of post 26 provides for clearance of a two way or V-shaped pusher plow and is not necessary for the proper functioning of the patrol wing plow blade 20 here shown.

Post assembly 26 consists of an elongated tube 35', rectangular in cross section and having one side slotted at 37', the slotted side facing outward at 90° to the direction of travel. At its lower end the post or way 35' has secured thereto at each side elongated ears 94 each provided with a plurality of holes **94*a* therethrough for selectively containing a bolt therethrough and through the flange of the cross member 28, as best seen in FIG. 2. Approximately midway up the post 35' two spaced ears 95 are secured to the post for securing and embracing between them the brace 30 as shown in FIG. 2**.

Figure 14:
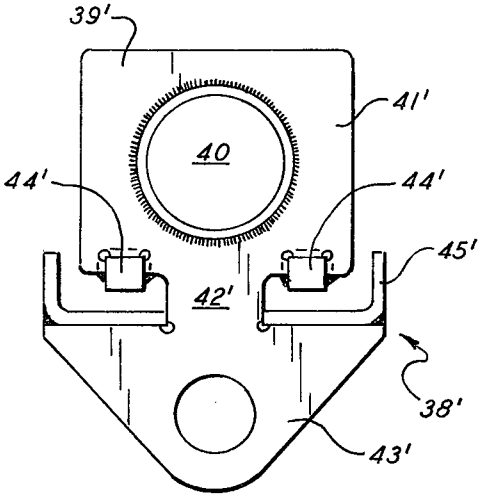
FIG. 14 is a further enlarged plan view of the front post slide.
Figure 15:
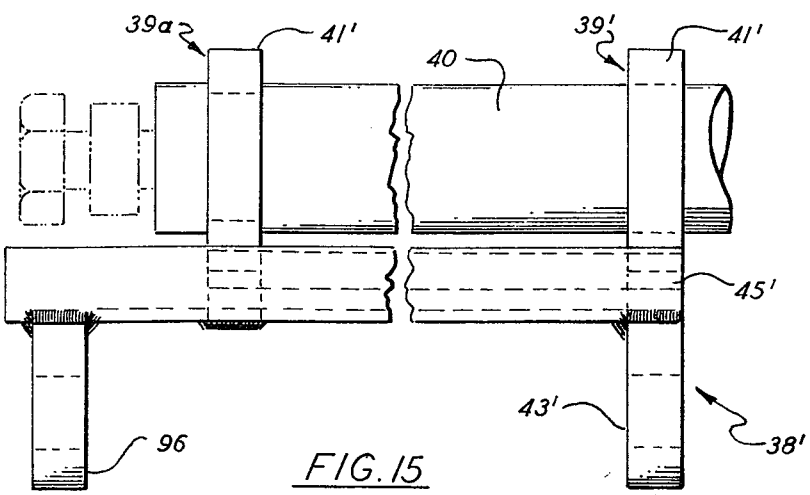
FIG. 15 is a side elevational view of the front post slide as viewed in the direction of arrows 15—15 of FIG. 2, a portion of the operating cylinder being shown in broken lines.

Slidingly received within post 35' is a slide member 38'. FIGS. 14 and 15, having spaced plates 39' and **39*a* having a cylinder 40 secured thereto like the plates 39 of the rear post, the bar 75' of FIG. 9 and the plate 41' are shown alternatively in FIG. 10 and the operation of the cylinder 40 is the same for both front and rear posts. As best seen in FIG. 15 both plates have a rectangular portion 41' adapted to slide in the post 35' and, joined to the rectangular portion, a narrowed tongue portion 42' projecting through the slot 37'. The upper plate 39' has a broadened portion 43' with a hole therethrough spaced from the rectangular portion 41', as best seen in FIG. 14. Rectangular portions 41' are secured together by vertically disposed friction members 44'** secured thereto as shown.

As best seen in FIG. 15, upper plate 39' has secured thereto a channel shaped slide or friction member 45' and this member extends past the lower plate **39*a* to a member 96 shaped like the portion 43' of the upper plate and welded to the slide member 45' for carrying the cylinder 40 relatively lower with respect to its way member than in the rear post 27. It will be understood that the double tube piston rod 50 of the front post is secured to a cross member 75' welded across the interior of post 35, as shown in FIG. 9**.

Slidably secured on elongated pin 97 having an elongated head and a cotter pin hole through its opposite end and extending through the holes in portion 43' of the upper plate and member 96 of the slide, is a pivoting and swiveling assembly having a bolt 99 for securing it to the front end of blade 20 as shown in FIG. 1 and FIG. 2.

Figure 16:
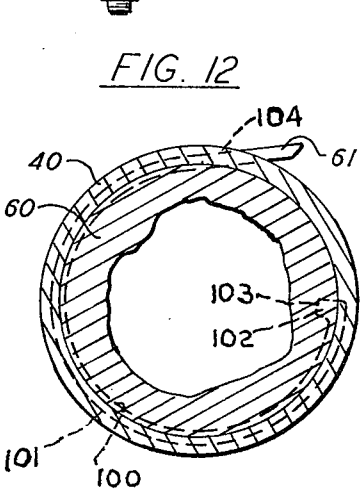
FIG. 16 is a sectional view on the line 16—16 of FIG. 10.

Referring now to FIG. 16 the substantially C-shaped stainless spring steel retaining key 61 mentioned above in connection with the description of cylinder head 60 shown in FIG. 10, is shown in fragmentary section. The key 61 is partially circular but extends for less than a full circle in matching slots 100 around a portion of the perimeter of the head 60 and slot 101 around a portion of the interior of cylinder 40. One end of key 61 is shown projecting from the outer surface of the cylinder and the other end has an inwardly projecting boss 102 contained in a cooperating depression 103 in head 60 at one end of slot 100. The projecting end of key 61 is contained in a hole 104 in cylinder 40 at the corresponding other end of slot 101.

It will be seen, with reference to FIG. 10, that a spanner wrench may be placed on the enlarged lower end of head 60 and, with another wrench, cylinder 40 may be rotated counterclockwise thereto, as viewed in FIG. 16, and the projecting end of key 61 will be ejected through the hole 104. The cylinder 40 may then be removed for replacement of any seals in head 60 or piston 49 which may be needed.

While the patrol wing plow has been shown as being carried on the right hand side of vehicle 21, it will be understood that the parts of plow 20 and posts 26 and 27 may be provided in mirror image counterparts so that the plow may be carried also on the left hand side.

I claim:

1. Hanger means for a patrol wing plow blade on a snow plow vehicle comprising substantially vertically extending front and rear tubular ways, each way tube being secured to the vehicle and having a single longitudinally extending slot therein, slide means for each way partially within and partially without the way and having portions extending through the way slot, a double action hydraulic cylinder in each way, the cylinder being secured to the portion of the slide within the way, a piston within the cylinder having a piston rod extending downward in the way and having its lower end secured to the lower end of the way, the rod having a first passage therein extending from the bottom end up through the piston and in communication with the interior of the cylinder above the piston and a second passage extending from a point adjacent the bottom of the way to a point adjacent the piston and in communication with the interior of the cylinder below the piston, each passage having means at the bottom of the way for connecting the passage with a source of fluid under pressure, the respective portion of each slide outside the way being operatively connected to opposite ends of the plow blade, whereby the plow ends are raised and lowered by the selective admission of fluid under pressure to the passages.

2. Hanger means for a patrol wing plow blade on a snow plow vehicle comprising substantially vertically extending front and rear tubular ways, the ways being polygonal in cross section and secured to the vehicle, each way having one longitudinally slotted side, each way having slide means partially within and partially without the tubular way, portions of each slide extending through the side slot, a double action hydraulic cylinder in each way, the cylinder being secured to the portion of the slide within the way, a piston within the cylinder having a piston rod extending downward in the way and having its lower end secured to the lower end of the way, the rod having a first passage therein extending from the bottom end up through the piston and in communication with the interior of the cylinder above the piston and a second passage extending from a point adjacent the bottom of the way to a point adjacent the piston and in communication with the interior of the cylinder below the piston, each passage having means at the bottom of the way for connecting the passage with a source of fluid under pressure, the portion of each slide outside the way being operatively connected to opposite ends of the plow blade, whereby the plow ends are raised and lowered by the selective admission of fluid under pressure to the passages.

3. Hanger means for a patrol wing plow blade on a snow plow vehicle as defined in claim 2 wherein the ways are rectangular in cross section, each way having one longitudinally slotted side, each way having slide means which have portions interior of the way having dimensions complimentary to the inside cross-sectional post dimensions for sliding contact with the inner surfaces of the way, the slide means also having portions exterior to the way having sliding contact with the outside surface of the slotted side of the way, the slide means also having portions lying in the slide slot of the way connecting the interior and exterior portions.

4. Hanger means for a patrol wing plow blade on a snow plow vehicle as defined in claim 3 wherein the rear rectangular tubular way has a reinforcement member substantially channel-shaped in cross section and having the leg flanges of the channel welded to the rectangular way on either side of a corner of the way, the web side of the channel being secured to the vehicle chassis facing toward the side members of the vehicle chassis between the vehicle cab and vehicle body and the rectangular tubular way so disposed in the reinforcement member as to have its slotted side facing forward at an angle of substantially 30° to the direction of travel of the vehicle, whereby a minimal space between cab and body is required for the rear rectangular way.

5. Hanger means for a patrol wing plow blade on a snow plow vehicle as defined in claim 3 wherein the double action hydraulic cylinder in each way and secured to the portion of the slide within the way has a piston within the cylinder having a double tube piston rod projecting downward from the cylinder, the rod having an inner tube telescoped within an outer tube with an annular space between tubes, the inner tube being in sealed engagement with the piston and having its passage therethrough in communication with the interior of the cylinder above the piston, the outer tube being secured to the piston and having passage means through its sidewall adjacent the piston in communication with the annular space and the interior of the cylinder below the piston, the lower end of the outer tube being secured to the bottom end of the way and having a passage therethrough adjacent the bottom of the way in communication with the annular space and adapted for connection with a source of fluid under pressure, the inner tube extending beyond the outer tube at its bottom end and having the lower end passage therethrough adapted for connection to the source of fluid under pressure, the outer tube at its lower end being in sealed engagement with and secured to the inner tube, whereby the plow ends are raised and lowered by the selective admission of fluid under pressure to the passages at the lower ends of the tubes.

6. Lift means for a small plow blade carried by a vehicle requiring powered movement from a position in contact with the ground to a position above the chassis of the vehicle comprising an elongated hollow tubular way secured in a substantially vertical position to the chassis, the way being rectangular in cross section and having a longitudinally extending central slot through one side; slide means having an inner portion conforming to the interior of the way, an outer portion slidably positioned against the outer surface of the slotted side, and a narrowed portion extending through the slot and connecting the inner and outer portions; a double action hydraulic cylinder within the way, the lower end of the cylinder being secured to the inner portion of the slide, a piston in the cylinder having a double tube piston rod projecting downward from the cylinder, the rod having an inner tube within an outer tube with an annular space therebetween, the inner tube being in sealed engagement with the piston and having its central passage in communication with the interior of the cylinder above the piston, the outer tube being secured to the piston and having passage means through the sidewall thereof adjacent the piston communicating with the annular space and the interior of the cylinder below the piston, the lower end of the outer tube being secured to the bottom of the way and having passage means through the sidewall thereof in communication with the annular space and adapted for connection with a source of fluid under pressure, the inner tube extending beyond the outer tube at its bottom end and having the lower end of the passage therethrough adapted for connection to the source of fluid under pressure, the outer tube at its lower end being in sealed engagement with and secured to the inner tube, whereby the plow blade is raised and lowered by the selective admission of fluid through the inner tube and through the annular space between tubes respectively.

7. Lift means as defined in claim 6 wherein the slide means includes a plate having a portion conforming to the interior of the way, the conforming portion having a circular hole therethrough substantially at its center and of a diameter equal to the inside diameter of the cylinder, the cylinder having at its lower end a tubular head in sealed engagement with the inside of the cylinder and with the outer tube of the piston rod, the head having an enlarged annular lower end spaced from the lower end of the cylinder a distance substantially equal to the thickness of plate portion conforming to the interior of the way, and the means for securing the lower end of the cylinder to the inner portion of the slide comprising a substantially C-shaped retaining key rectangular in cross section and having an annular portion extending more than a half circle and less than a full circle, the annular portion lying in matching slots in the interior of the cylinder and partially around the outer surface of the head within the cylinder, one end of the key having an inwardly projecting boss lying in a cooperating hole in the head and the other end of the key projecting tangentially of the head and through a hole through the cylinder wall, whereby the key is ejected through the cylinder wall hole by turning the cylinder with respect to the head and the cylinder may be removed for replacement of parts in the piston and in the head.

* * * * *